US005312047A

United States Patent [19]

Akers

[11] Patent Number: 5,312,047

[45] Date of Patent: May 17, 1994

[54] LAWN MOWER WASHER RING

[76] Inventor: Louis A. Akers, 3026 Edgewood, Alton, Ill. 62002

[21] Appl. No.: 149,303

[22] Filed: Nov. 9, 1993

[51] Int. Cl.[5] ..... B05B 15/06

[52] U.S. Cl. ..... 239/276; 239/279; 239/559; 239/562; 239/DIG. 6

[58] Field of Search ..... 239/273, 276, 279, 559, 239/562, 567, DIG. 6; 134/198; 56/12.1

[56] References Cited

U.S. PATENT DOCUMENTS

| | | | |
|---|---|---|---|
| 648,263 | 4/1900 | Hull | 239/567 X |
| 2,456,703 | 12/1948 | Hatchette | 239/562 X |
| 2,771,320 | 11/1956 | Korwin | 239/279 |
| 3,108,608 | 10/1963 | Mahowald . | |
| 3,214,893 | 11/1965 | Griffin . | |
| 3,322,347 | 5/1967 | Pierce . | |
| 3,648,446 | 3/1972 | Haapoja et al. . | |
| 3,856,028 | 12/1974 | Kehler . | |
| 4,562,963 | 1/1986 | Butler | 239/273 |
| 4,762,278 | 8/1988 | Taylor | 239/567 X |
| 4,779,800 | 10/1988 | Tuomi | 239/276 |
| 4,784,327 | 11/1988 | Lund . | |
| 5,152,459 | 10/1992 | Boeh . | |

FOREIGN PATENT DOCUMENTS

| | | | |
|---|---|---|---|
| 531185 | 9/1954 | Belgium | 239/559 |
| 10089 | 6/1988 | United Kingdom | 239/567 |

*Primary Examiner*—Andres Kashnikow
*Assistant Examiner*—William Grant
*Attorney, Agent, or Firm*—Bruce J. Bowman

[57] ABSTRACT

A spraying device for dousing the blade chamber of a rotary lawn mower to effect cleaning thereof. An annular, D-shaped conduit is secured to the ground by a centrally disposed stake. The stake orients the flat portion of the D-shaped conduit against the ground, providing a low profile in order for the mower to be positioned over the spraying device. The annular conduit has a plurality of orifices disposed on the top surface defining first and second annular formations. The first annular formation upwardly directs a controlled spray pattern perpendicular to the ground, while the second annular formation upwardly and outwardly directs a controlled spray pattern preferably 45° from the perpendicular. A valved extension conduit in communication with the annular conduit is releasably coupled to a water source such as a garden hose connected to a water faucet for supplying the spraying device with pressurized water.

18 Claims, 2 Drawing Sheets

LAWN MOWER WASHER RING

BACKGROUND OF THE INVENTION

1. Field of the Invention

This invention relates to the cleaning of rotary lawn mowers and, more particularly, to a washing ring for cleansing the underside of rotary lawn mowers.

2. Description of the Prior Art

Lawn mowers of various types are well known. Whether powered by an electric motor or by a gasoline engine, such lawn mowers normally include a rigid housing that generally encircles a centrally located rotatable blade that is coupled to the motor or engine. A portion of the sidewall of the housing is usually open and formed into a chute through which the lawn clippings are discharged by the rotating action of the blade.

Inevitably, during a lawn mowing operation, the lawn clippings, e.g. grass clippings, leaves, and other chopped debris, will adhere to the interior surface of the housing, shroud, or cowling. Since the interior surface of the housing is generally not a smooth surface, such lawn clippings will accumulate within the chamber, especially in the corners of the housing. The lawn cutting action forces the clippings against the interior surface of the housing where they become compacted. The accumulated lawn clippings thus clog and plug the mower or cause it to become sluggish in operation. This is especially true when the lawn is wet or damp.

When the lawn mower is fouled by lawn clippings it is necessary to clean the underside of the housing, and this entails removing the lawn clippings. Failure to consistently remove the lawn clippings from the housing degrades the performance of the lawn mower and accelerates corrosion of the housing. The dried lawn clippings also fall on the floor and litter the storage area.

In order to clean the interior surface of the housing, the lawn mower must be inverted or turned over on its side. The compacted clippings must be scrapped off from the interior surface, while the loose clippings must be washed away.

However, it has been recognized that rotary lawn mowers may be cleaned when water is introduced into the underside of the housing while the motor is operating. The rotating blades help distribute the water within the housing.

There have heretofore been various devices for attempting to clean the underside of a lawn mower. These devices can essentially be classified into two general categories. The first general category represents those devices or systems that are integral with the housing of the lawn mower. A water source is coupled to the integral washing system which injects water from nozzles disposed essentially flush with the top underside surface of the housing.

The second general category represents those devices that spray water from the below the housing. The lawn mower is thus situated over, or onto, the device which then sprays the water into the housing.

Most of the devices of the second category are, or incorporate, essentially circular, round water supply tubes with an indiscriminate plurality of holes for the water to issue forth. Designs in which the water tube is not incorporated into a platform or otherwise, the tube is simply placed on the ground. These prior art designs are generally either bulky, as in the case of platforms and the like, or questionably effective.

It is therefore an object of the present invention to provide a washing device for a lawn mower that has a low profile in order that the mower housing and blade clears the washing device.

It is another object of the present invention to provide a spraying device that in conjunction with the rotating blade develops suitable fluid pressure to dislodge clippings from the blade chamber of the lawn mower.

It is further an object of the present invention to provide a spraying device for cleansing all types rotary lawn mowers that is adequately, releasably securable onto the ground.

It is yet another object of the present invention to provide a spraying or cleansing device for lawn mowers that directs a controlled spray pattern into the blade chamber such that only the portions within the blade chamber that usually get clogged and compacted with clippings are cleaned.

SUMMARY OF THE INVENTION

The present invention attains the above objects by providing an annular D-shaped conduit having a select number of equalannularly spaced orifices defining a controlled spray pattern that in conjunction with the rotating mower blade, develops an effective fluid spray, and a stake for releasably securing the conduit onto the ground.

The annular D-shaped conduit thus has an annular flat portion on one axial end that defines the D-shape, and which is adapted to abut the surface of the ground when secured by the stake.

In one form thereof, the present invention provides a spraying device for cleansing the underside of a rotary mower with water. The spraying device comprising an annular conduit having an annular flat portion at one axial end, the annular flat portion being adapted to abut the ground, a support radially inwardly extending from the annular conduit, along with a spike retained by the support and adapted to be inserted into the ground to releasably retain the annular flat portion against the ground. Further, the spraying device comprises a hose coupler in fluid communication with the annular conduit, the hose coupler adapted be couple with a water hose that carries pressurized water, and a plurality of orifices disposed in the annular conduit. The orifices define an annular spray pattern that directs the water from the annular conduit at an angle defined from a vertical axis of the annular conduit of between 0° and 45° inclusive.

In another form thereof, the present invention provides a spraying device for dousing the blade chamber of a mower with a fluid cleansing agent. The spraying device comprises, an annular conduit having an annular flat portion on one axial end thereof such that a cross-section of the annular conduit taken along a plane parallel to a vertical axis of the annular conduit defines a substantially D-shaped toroid. A conduit extension has one end in fluid communication with the annular conduit, while a hose coupler is coupled at another end of the conduit extension, with the hose coupler adapted to be attached to a water hose. A valve is disposed in the conduit extension proximate the hose coupler. The annular conduit includes a plurality of apertures defining a controlled spray pattern that operates in conjunction with the rotating mower blade to effectively cleanse the blade chamber. A support is disposed radially interiorly to the annular conduit, the support including a plurality of arms each attached to the annular conduit, with a stake attached to the support for extending into the ground to releasably immobilize the spraying device, the stake being adapted to maintain the annular flat portion of the annular conduit against the ground.

The controlled spray pattern is preferably a first annular formation of apertures that upwardly directs a spray pattern perpendicular to the ground, and a second annular formation of apertures that upwardly and outwardly directs a spray pattern at an angle from a vertical axis of said annular conduit of between 0° and 46°. The first and second annular formations of apertures each has, preferably, twelve equalannularly spaced apertures.

BRIEF DESCRIPTION OF THE DRAWINGS

So that the manner in which the above-recited features, advantages, and objects of the present invention are attained and can be understood in detail, a more particular description of the invention, briefly summarized above, may be had by reference to the embodiments thereof which are illustrated in the appended drawings. Corresponding reference characters indicate corresponding parts throughout the several views.

It is noted, however, that the appended drawings illustrate only typical embodiments of this invention and is therefore not to be considered limiting of its scope, for the invention may admit to other equally effective embodiments. Reference the appended drawings, wherein.

DESCRIPTION OF THE PREFERRED EMBODIMENT

Figure 1:
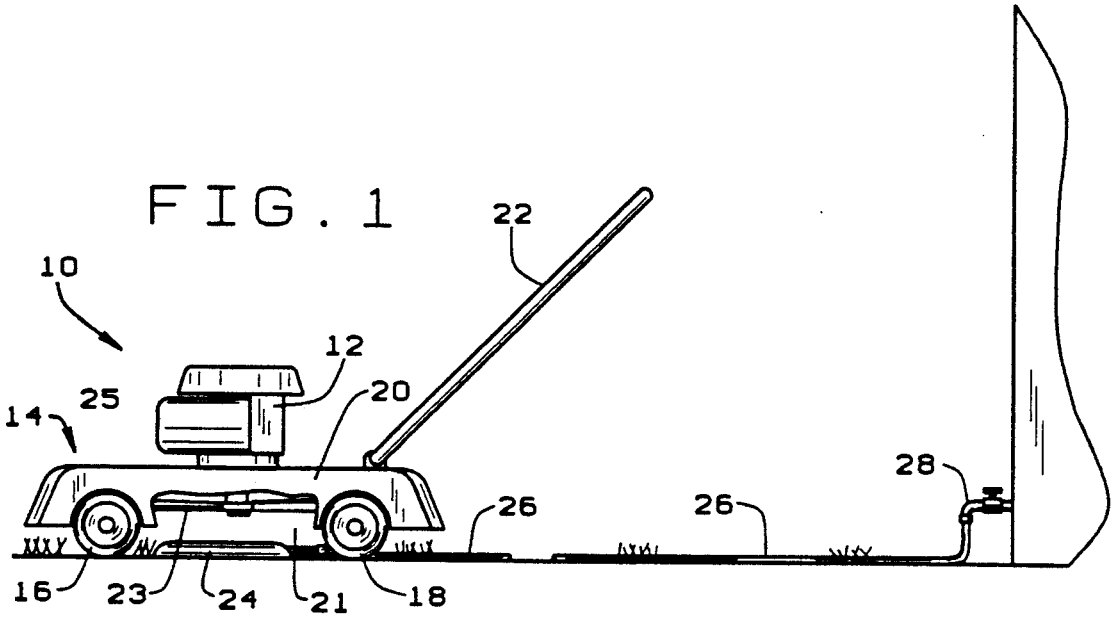
FIG. 1 is an elevational view of a typical walk-behind lawn mower positioned over the present washer ring, the washer ring secured to the ground and coupled to a water source.

Referring to FIG. 1, there is shown a typical walk-behind rotary lawn mower designated 10. Lawn mower 10 includes an engine 12 mounted on a base 14 that is supported by two pairs of opposed wheels, of which only two wheels 16 and 18 are shown. A handle 22 is attached to the base 14 for manually guiding and/or pushing the lawn mower. Base 14 includes a housing, shroud, or cowling 20 that extends around the wheels and a rotatable blade 23. An interior surface 25 of housing 20 encloses the blade 23 and defines a blade chamber 21 within which the blade 23 rotates and the lawn clippings whirl.

It should be understood that any type of lawn mower may utilize the present invention, thus, although a rotary, walk-behind mower is depicted in FIG. 1, the present invention is not limited to such use, and therefore may be used with riding lawn mowers, garden tractors, and other propelled or self-propelled lawn mowers.

In accordance with the present invention, a washer ring 24 is positioned on the surface of the ground and is coupled to a garden hose 26. The garden hose 26 is shown coupled to a water faucet, however, it should be understood that any water source of adequate pressure may suffice. Placement of the water ring 24 is preferably directly underneath or below the blade 23, but can be placed anywhere underneath the housing 20 where the water will be directed into the blade chamber 21. Positioning the water ring 24 directly below the blade 23 allows full utilization of the rotating blade during the cleansing process.

Although the washer ring 24 is oriented in FIG. 1 such that the water hose 26 connects with washer ring 24 from the rear of the mower 10, it should be understood that washer ring 24 may be oriented in any direction relative to the mower 10 and not degrade the performance of the washer ring 24.

Figure 2:
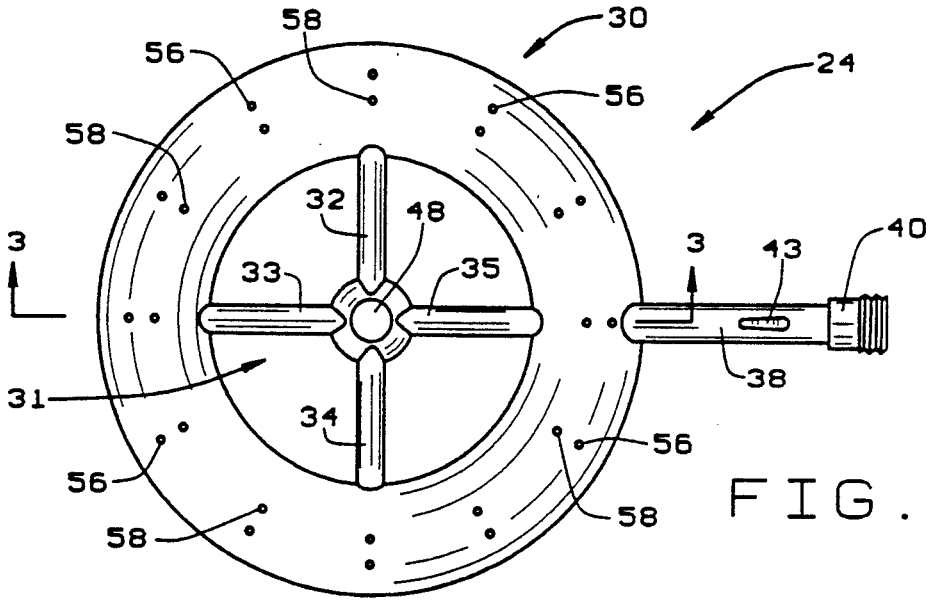
FIG. 2 is a top view of the present washer ring.
Figure 3:
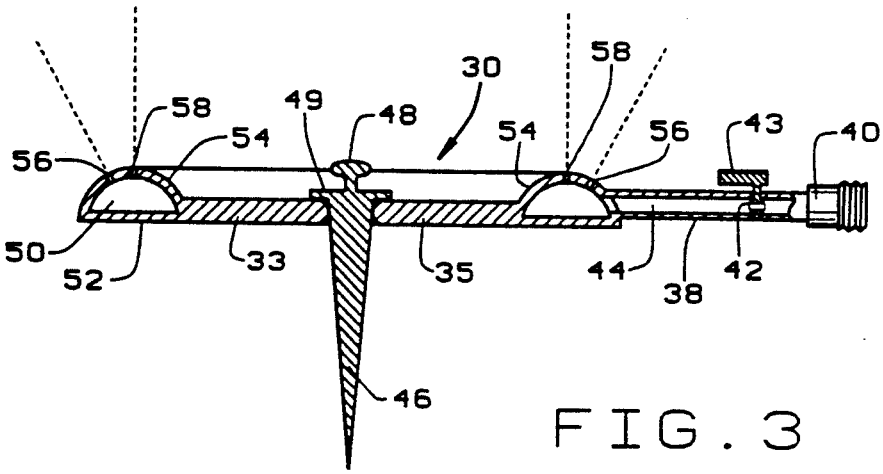
FIG. 3 is a sectional view of the present washer ring taken along line 3—3 of FIG. 2.

Referring now to FIGS. 2 and 3 there is depicted an enlarged view of the present washer ring 24. Washer ring 24 includes an annular conduit 30, preferably fabricated from a metal, typical of current lawn sprinklers and the like, such as stainless steel, aluminum, etc, but which can be a PVC or other material suitable as a water conduit for pressurized water. It has been found that the diameter of annular conduit 30 should, preferably, not exceed eight inches (8"), and can be less.

A support or brace 31 is disposed radially inwardly of annular conduit 30. Support 31 includes four arms 32, 33, 34, 35, each of which extend radially inwardly from a respective point on the inner periphery of annular conduit 30, the respective points being equidistant along the annular periphery or 90° from each other. It should here be appreciated that support 31 may include more arms or less arms than shown, or may constitute a plate or plate-like structure. Each arm 32, 33, 34, 35, terminates at a ring 49 that forms a part of spike or stake 46. Since annular conduit 30 is rigid, support 31 essentially provides a central position for stake 46 and retains the same.

Attached to a periphery of annular conduit 30 is a conduit extension 38 that is preferably fashioned from like materials as annular conduit 30. Conduit extension 38 is approximately twelve inches (12") in length, and terminates in a hose coupler 40 or like connector adapted to releasably attach to a typical garden hose or other water supply conduit. Since annular conduit 30 is preferably eight or less inches in diameter, conduit extension 38 allows an operator to connect and disconnect the water supply hose 26 and operate the valve 42 while the mower 10 is positioned over the washer ring 24.

Disposed within conduit extension 38 and proximate hose coupler 40 is a conventional type ball valve 42 or the like, with an actuating handle or lever 43 positioned on the surface of extension conduit 38. The ball valve 42 permits a range of water flow rates into annular conduit 30 from a maximum flow rate determined by the water supply to zero flow, such that the operator may turn on the flow of water from the faucet 28 and completely control the water from washer ring 24. It should be appreciated that valve 43 may be any type of suitable fluid valve that includes the ability to provide a range of flows varying from no flow to a maximum flow.

Specifically referring now to FIG. 3, annular conduit 30 is shown in cross-section. Annular conduit 30 defines an annular D-shaped interior chamber 50 that is in communication with passageway 44 defined by extension conduit 38. As can be appreciated from FIG. 3, annular conduit 30 includes an annular flat surface or portion 52 on one axial end, that essentially defines a cross-section of annular conduit 30 as a D-shaped toroid. Annular flat surface 52 is adapted to abut the surface of the ground when washer ring 24 is in operation, and provides stability thereto. Annular flat 52 also creates a low profile in order to allow the mower 10 to be placed thereover.

A stake 46 is centrally located relative to annular conduit 30 and as indicated above, is retained by support 31 through ring 49. Stake 46 includes a knob 48 that enables an operator to grasp and insert stake 46 into the ground in order to releasably retain or immobilize washer ring 24 onto the ground. Knob 48 also assists in the removal of stake 46 and thus washer ring 24. Stake 46 is oriented such that annular flat 52 abuts or is disposed adjacent the ground in order to achieve a low overall profile when inserted into the ground.

Annular conduit 30 includes a semicircular wall 54 in which there are disposed a plurality of orifices or apertures collectively designated 56 and 58. Apertures 56 form a first annular pattern or formation about annular conduit 30, while apertures 58 form a second annular pattern or formation about annular conduit 30. Each annular pattern 56, 58 includes a select number of apertures, preferably twelve, equally annularly spaced about annular conduit 30. Each annular pattern 56, 58 thus forms or defines an annular spray pattern or formation.

Figure 6:
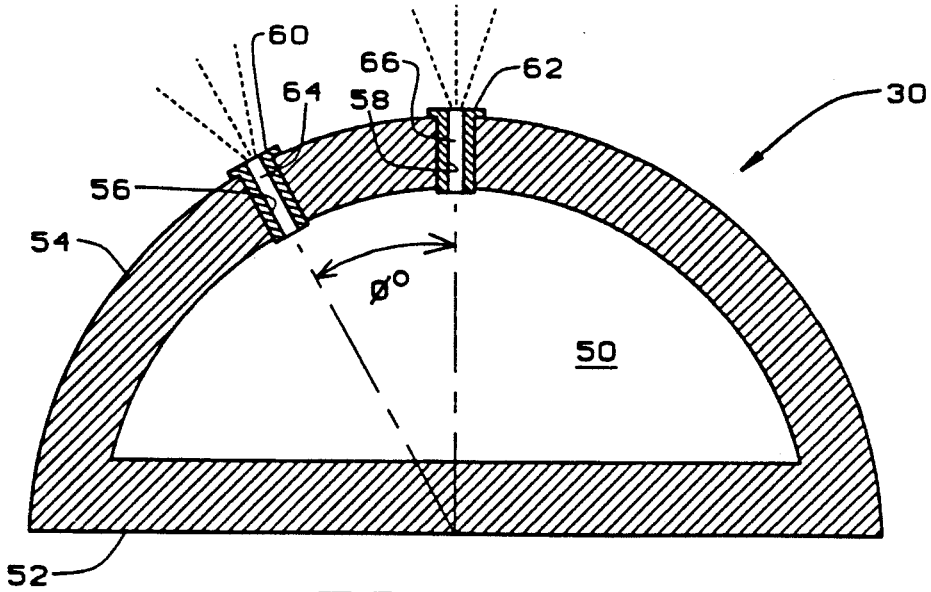
FIG. 6 is an enlarged sectional view of the annular conduit of the washer ring depicting the spraying orifices.

With particular reference to FIG. 6, each of the apertures collectively designated 56 and 58 includes respective spray nozzles collectively designated 60 and 62 that includes respective nozzle bores 64 and 66, collectively. The nozzles may be standard brass spray nozzles as is well known in the sprinkler or fluid spraying arts, or similar structures that allow for a controlled spray. Apertures 58 that define the second annular spray pattern are preferably disposed in wall 54 perpendicular to the ground or parallel to a vertical axis of washer ring 24, such that the spray emanating from each nozzle 62 is essentially directed upwardly. Apertures 56 that define the first annular pattern are situated at an angle $\phi$ ($\phi°$) from the perpendicular to the ground or parallel to the vertical axis of between 0° to 46°, and preferably, as depicted, at a $\phi°$ of 45°. The perpendicular annular spray pattern defined by collective apertures 58 directs the cleansing water spray essentially vertically upwards into the blade chamber 21 and blade 23, while the angled annular spray pattern defined by collective apertures 56 directs the cleansing water spray essentially outwardly towards the corners of the interior surface 25 of housing 20. The angled annular spray pattern thus directs the cleansing water towards the area within the blade chamber 21 that generally clogs and compacts with clippings the most. It should also here be noted that the present washer ring is designed to operate with the mower running and the blade rotating in order to most effectively distribute the water and swirl it at sufficient velocity to dislodge the compacted clippings and thoroughly cleanse the blade chamber 21.

Figure 4:
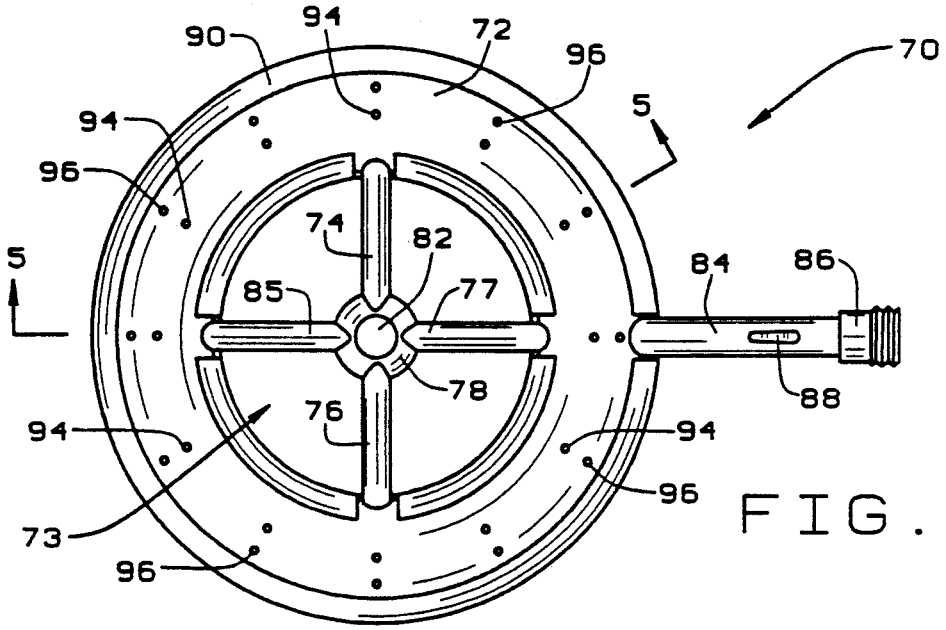
FIG. 4 is a top view of an alternate embodiment of the present washer ring.
Figure 5:
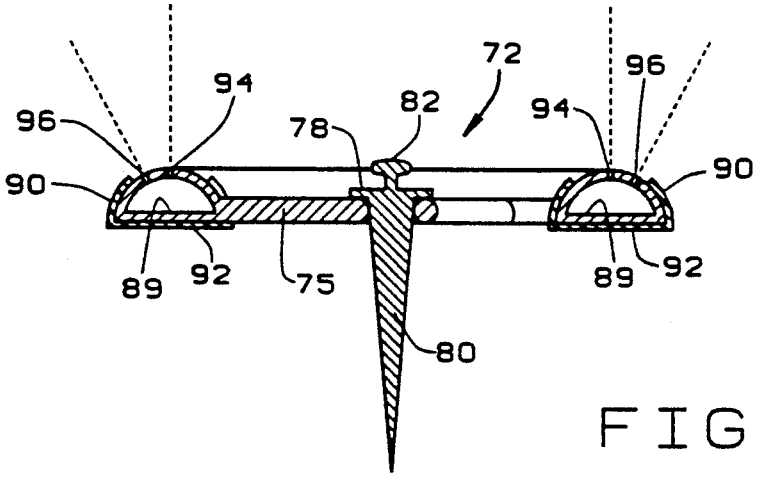
FIG. 5 is a sectional view of the washer ring of FIG. 4 taken along line 5—5 thereof.

Referring to FIGS. 4 and 5 there is shown an alternative embodiment of the washer ring depicted in FIGS. 2 and 3, and described hereinabove. Washer ring 70 of FIG. 4 includes an annular conduit 72 with a support structure or brace 73 having four arms 74, 75, 76, 77 that each radially inwardly extend from an inner periphery of the annular conduit 72 in like manner to the washer ring 24 of FIGS. 2 and 3. The arms 74, 75, 76, 77 terminate at ring 78 of a spike or stake 80. A knob 82 is disposed on the upper part of ring 78 for grasping the spike 80 for inserting and removing the spike 80 as described hereinabove with reference to washer ring 24.

Annular conduit 72 is likewise connected to an extension conduit 84 so as to be in fluid communication therewith. Extension conduit 84 terminates in a hose coupler 86 that is adapted to couple to a hose or other water supply conduit. A valve (not shown) is disposed in extension conduit 84 proximate hose coupler 86, in like manner to washer ring 24, and includes a valve actuator handle or lever 88 for permitting the operator the control the flow of water from a no flow to a full flow at the washer ring 72 itself rather than at the water source or faucet.

Annular conduit 72 further includes a plurality of apertures collectively designated 94 and 96. In like manner, function, and form to collective apertures 56 and 58 of washer ring 24, collective apertures 94 forms or defines a first annular spray pattern or formation that directs water upwardly perpendicular to the ground or parallel to a vertical axis of the washer ring, while collective apertures 96 forms or defines a second annular spray pattern or formation that directs water upwardly and radially outwardly at an angle defined from the perpendicular (see FIG. 6). This angle is defined by and follows the same criteria as that for washer ring 24, above.

Washer ring 72 includes a stand or guard 92 that essentially encompasses and conforms to the outer surface of annular conduit 72, and may be fabricated from a plastic such as is common to current sprinklers and known in the art. In this manner an annular flat portion 92 of stand 92 is disposed adjacent annular flat portion 89 of annular conduit 72. Stand or guard 72 thus protects annular conduit 72 from puncture or otherwise.

It should be appreciated that in both embodiments, only one annular spray pattern or formation is necessary for the efficient functioning of the present invention. It is preferred that the single pattern be the angled annular spray pattern defined by the radially outwardly disposed apertures (56 of FIGS. 2 and 3; 96 of FIGS. 4 and 5).

In operation, when the operator decides to cleanse the mower, preferably a short time after finishing the mowing, the washer ring is placed onto the ground. This may be accomplished virtually anywhere, but preferably where the ground is flat and a hose or other water supply conduit is available. Referring to the embodiment depicted in FIGS. 2 and 3, the operator grasps knob 48 and pushes or drives stake 46 fully into the ground until the annular flat portion 52 abuts the surface of the ground.

At this point valve 42 should be closed. A hose is connected to hose coupler 40 and the water supply is commenced to flow. The operator may then either actuate lever 43 to open the valve 42 to the desired flow and position the running mower over washer ring 24, or actuate the valve 42 after positioning the mower thereover. Although the present washer ring 24 can operate without the mower running, it is more effective if the blade is rotating to help circulate and throw the water or cleansing fluid into the blade chamber. The procedure is reversed in order to cease cleansing the mower.

While the foregoing is directed towards the preferred embodiment of the present invention, other and further embodiments of the invention may be devised without departing from the basic scope thereof, and the scope thereof is determined by the claims which follow.

What is claimed is:

1. A spraying device for cleansing the underside of a rotary mower with water, the spraying device comprising:

an annular conduit having an annular flat portion at one axial end, said annular flat portion adapted to abut the ground;

a support radially inwardly extending from said annular conduit;

a spike retained by said support and adapted to be inserted into the ground to releasably retain said annular flat portion against the ground;

a hose coupler in fluid communication with said annular conduit, said hose coupler adapted to be coupled with a water hose carrying pressurized water; and a plurality of orifices disposed in said annular conduit, said orifices defining an annular spray pattern that directs the water from said annular conduit at an angle defined from a vertical axis of said annular conduit of between 0° and 45° inclusive.

2. The spraying device of claim 1, wherein said angle is 45°.

3. The spraying device of claim 1, wherein said plurality of orifices equals twelve, said twelve orifices equalannularly spaced about said annular conduit.

4. The spraying device of claim 1, wherein said annular conduit is D-shaped.

5. The spraying device of claim 1, further comprising:

an integral extension of conduit in fluid communication with said annular conduit at one end, and with said hose coupler at another end; and a valve disposed in said integral extension of conduit adjacent said hose coupler.

6. The spraying device of claim 1, wherein said annular conduit has a maximum diameter of 8 inches.

7. A spraying device for cleaning the blade chamber of a rotary lawn mower with a fluid cleansing agent, the spraying device comprising:

an annular conduit having an annular flat on one axial end;

a stake attached to the annular conduit and adapted to extend into the ground to releasably immobilize the spraying device and orient said annular flat adjacent the ground;

means for coupling said annular conduit to a pressurized fluid cleansing agent source; and a plurality of apertures disposed in said annular conduit for allowing the pressurized fluid to be ejected from said annular conduit in a controlled spray pattern, said controlled spray pattern defined by a first annular aperture formation and a second annular aperture formation;

said first annular aperture formation directing a portion of the fluid cleansing agent upwardly as a spray pattern perpendicular to the ground, said second annular aperture formation directing a remaining portion of the fluid cleansing agent upwardly and radially outwardly as a spray pattern at an angle defined from the perpendicular of between 0° and 46°.

8. The spraying device of claim 7, wherein said angle is 45°.

9. The spraying device of claim 7, wherein said plurality of apertures equals twenty-four, said first annular aperture formation consisting of twelve apertures equalannularly spaced about said conduit, and said second annular aperture formation consisting of twelve apertures equalannularly spaced about said conduit.

10. The spraying device of claim 7, wherein said annular conduit has a maximum diameter of 8 inches.

11. A spraying device for dousing the blade chamber of a mower with a fluid cleansing agent, the spraying device comprising:

an annular conduit having an annular flat portion on one axial end thereof such that a cross-section of said annular conduit taken along a plane parallel to a vertical axis of said annular conduit defines a substantially D-shaped toroid;

a conduit extension having one end in fluid communication with said annular conduit;

a hose coupler coupled to another end of said conduit extension, said hose coupler adapted to be attached to a water hose;

a valve disposed in said conduit extension proximate said hose coupler;

a plurality of apertures in said annular conduit, said plurality of apertures defining a controlled spray pattern;

a support disposed radially interiorly to said annular conduit, said support having a plurality of arms each attached to said annular conduit; and a stake attached to said support for extending into the ground to releasably immobilize the spraying device, said stake adapted to maintain said annular flat portion of said annular conduit against the ground.

12. The spraying device of claim 11, wherein said annular conduit has a maximum diameter of 8 inches.

13. The spraying device of claim 11, wherein said controlled spray pattern is an annular formation of apertures that directs a spray at an angle from a vertical axis of said annular conduit of between 0° and 45° inclusive.

14. The spraying device of claim 13, wherein said angle is 45°.

15. The spraying device of claim 13, wherein said plurality of apertures equals twelve, said twelve apertures equalannularly spaced on said annular conduit.

16. The spraying device of claim 11, wherein said controlled spray pattern is a first annular formation of apertures that upwardly directs a spray pattern perpendicular to the ground, and a second annular formation of apertures that upwardly and outwardly directs a spray pattern at an angle from a vertical axis of said annular conduit of between 0° and 46°.

17. The spraying device of claim 16, wherein said angle is 45°.

18. The spraying device of claim 16, wherein said first and second annular formation of apertures each has twelve equalannularly spaced apertures.

* * * * *